US008699914B2

(12) United States Patent
Kato et al.

(10) Patent No.: US 8,699,914 B2
(45) Date of Patent: Apr. 15, 2014

(54) TANDEM DRUM UNIT HAVING RESILIENTLY MOVABLE ABUTMENT PORTIONS

(75) Inventors: Shuichi Kato, Nagoya (JP); Junichi Hashimoto, Toyohashi (JP); Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 363 days.

(21) Appl. No.: 13/072,715

(22) Filed: Mar. 27, 2011

(65) Prior Publication Data

US 2011/0318055 A1 Dec. 29, 2011

(30) Foreign Application Priority Data

Jun. 24, 2010 (JP) ..... 2010-143689

(51) Int. Cl.
*G03G 21/18* (2006.01)

(52) U.S. Cl.
USPC ..... 399/112

(58) Field of Classification Search
USPC ..... 399/111, 112, 113, 119
See application file for complete search history.

(56) References Cited

U.S. PATENT DOCUMENTS

| | | | | |
|---|---|---|---|---|
| 6,101,349 | A * | 8/2000 | Ohashi et al. | 399/110 |
| 6,519,430 | B2 * | 2/2003 | Higeta et al. | 399/109 |
| 7,209,676 | B2 * | 4/2007 | Yokoi et al. | 399/90 |
| 7,426,355 | B2 * | 9/2008 | Okabe | 399/111 |
| 7,555,237 | B1 * | 6/2009 | Han et al. | 399/111 |
| 7,986,897 | B2 * | 7/2011 | Nishimura | 399/90 |
| 2007/0147888 | A1 | 6/2007 | Igarashi | |
| 2008/0240774 | A1 | 10/2008 | Fukamachi et al. | |
| 2010/0111562 | A1 * | 5/2010 | Okabe et al. | 399/112 |
| 2010/0135694 | A1 | 6/2010 | Hashimoto et al. | |

FOREIGN PATENT DOCUMENTS

| | | | |
|---|---|---|---|
| JP | H05-079524 | U | 10/1993 |
| JP | H07-092881 | A | 4/1995 |
| JP | 2005-148702 | A | 6/2005 |
| JP | 2007-127995 | A | 5/2007 |
| JP | 2007-199652 | A | 8/2007 |
| JP | 4000446 | B2 | 10/2007 |
| JP | 2008-249802 | A | 10/2008 |
| JP | 2009-103737 | A | 5/2009 |
| JP | 2010-128342 | A | 6/2010 |

OTHER PUBLICATIONS

Japan Patent Office, Office Action for Japanese Patent Application No. 2010-143689 (counterpart to above-captioned patent application), mailed May 8, 2012.

* cited by examiner

*Primary Examiner* — Robert Beatty
(74) *Attorney, Agent, or Firm* — Baker Botts L.L.P.

(57) ABSTRACT

A tandem drum unit includes a pair of side plates, a plurality of photosensitive drums and a plurality of developing cartridge accommodating sections. The plurality of photosensitive drums is juxtaposed in a second direction, each photosensitive drum having an axis extending in a first direction and supported rotatably about the axis by the pair of side plates. Each developing cartridge accommodating section accommodating therein a developer cartridge having a casing and a connecting frame extending in the first direction and connected to the pair of side frames. The casing of each developer cartridge is seated on at least two abutment portions, the at least two abutment portions being positioned spaced away from each other in the first direction, wherein the plurality of connecting frames includes an endmost connecting frame in the second direction having a specific abutment portions resiliently movable in the pressing direction of the developer cartridge.

6 Claims, 7 Drawing Sheets

TANDEM DRUM UNIT HAVING RESILIENTLY MOVABLE ABUTMENT PORTIONS

CROSS REFERENCE TO RELATED APPLICATION

This application claims priority from Japanese Patent Application No. 2010-143689 filed Jun. 24, 2010. The entire content of the priority application is hereby incorporated by reference in its entirety.

TECHNICAL FIELD

The present invention relates to a tandem drum unit provided in an image forming device such as a laser printer.

BACKGROUND

A tandem color printer having a detachably mountable tandem drum unit is well known. Four photosensitive drums corresponding to four colors (yellow, magenta, cyan and black) are supported to the drum unit. The photosensitive drums are thus integrally detachably mountable in a main casing of the color printer.

The drum unit includes four drum sub-units, a front beam, a rear beam and a pair of side frames. Each drum sub-unit has a sub-unit frame that supports the photosensitive drum. The four drum sub-units are juxtaposed between the front beam and the rear beam in a front-to-rear direction. The four drum sub-units, the front beam and the rear beam are integrally interposed between the pair of side walls in a left-to-right direction.

Each drum sub-unit is formed with a space at a front side thereof. Each space is used as a developing cartridge accommodating section for accommodating therein a developing cartridge including a developing roller. The developing roller has a developing roller shaft that is rotatably supported to a casing of the developing cartridge. The developing roller shaft has widthwise ends protruding outward from the casing of the developing cartridge. Each of the pair of side walls of the drum unit is formed with four guide grooves at positions in confrontation with the four developing cartridge accommodating sections for guiding loading of the developing cartridge into the developing cartridge accommodating section.

Upon loading of the developing cartridge into the developing cartridge accommodating section, the widthwise ends of the developing roller shaft are inserted into the corresponding guide grooves from above. The developing cartridge is then slidingly moved toward the developing cartridge accommodating section while being guided along the guide grooves. When the developing roller is brought into contact with the corresponding photosensitive drum, the developing cartridge is prevented from moving further. The developing cartridge is then tilted (pivotally moved) about the developing roller shaft toward the neighboring drum sub-unit positioned frontward or toward the front beam.

The front beam and the sub-unit frame of each drum sub-unit respectively have surfaces against which the developing cartridge is tilted. On these surfaces of the front beam and the sub-unit frame, two supporting rollers are disposed in separation from each other in an axial direction of the photosensitive drum. When the developing cartridge leans on the front beam or on the drum sub-unit, the casing of the developing cartridge is brought into contact with the supporting rollers. The developing cartridge is thus supported within the developing cartridge accommodating section at four contact points: at two contact points where the widthwise ends of the developing roller shaft are supported by the pair of side frames of the drum unit; and at two contact points where the casing of the developing cartridge is supported by the two supporting rollers.

SUMMARY

In order for the developing cartridge to be reliably supported within the developing cartridge accommodating section, preferably, the developing roller be supported at as many contact points as possible. However, increasing a number of contact points requires a high degree of accuracy in design. In practice, the casing of the developing cartridge and the sub-unit frame of the drum sub-unit are produced with some tolerance. Therefore, increasing the number of contact points involves difficulty.

Further, the sub-unit frame of the drum sub-unit is designed to be resiliently deformable in order to absorb the production tolerance. A rotational moment exerted on the developing cartridge at the time of input of a driving force increases a force with which the casing of the developing cartridge is pressed against the drum sub-units or the front beam. In response to the increased force acting on the developing cartridge, the drum sub-unit can resiliently deform so that the developing cartridge can be readily supported at the four contact points.

However, generally, the front beam needs to have sufficient strength to prevent deformation since the front beam constitutes an outer frame of the drum unit together with the rear beam and the pair of side frames. Therefore, when the casing of the developing cartridge is pressed against the front beam, the casing of the developing cartridge resiliently deforms or is distorted such that the developing cartridge can be supported at the four contact points. As a result, an attitude of the developing roller that is supported to the casing of the developing cartridge is caused to change, thereby making a contact pressure between the developing roller and the corresponding photosensitive drum non-uniform with respect to the axial direction of the photosensitive drum. An amount of toner supplied from the developing roller to the photosensitive drum thus becomes non-uniform in the axial direction, possibly leading to defect in image formation, such as blocky images.

In view of the foregoing, it is an object to the present invention to provide a tandem drum unit that can prevent deformation of a casing of a developing cartridge mounted in the drum unit upon input of a driving force to a developing roller of the developing cartridge.

In order to achieve the above and other objects, the present invention provides a tandem drum unit including a tandem drum unit including a pair of side plates, a plurality of photosensitive drums, a plurality of developing cartridge accommodating sections and at least two abutment portions provided on each connecting frame. The pair of side plates is disposed in opposition to each other in a first direction, each side plate extending in a second direction perpendicular to the first direction. The plurality of photosensitive drums is juxtaposed in the second direction and interposed between the pair of side plates in the first direction, each photosensitive drum having an axis extending in the first direction and supported rotatably about the axis by the pair of side plates. The plurality of developing cartridge accommodating sections is arrayed in the second direction in correspondence with the plurality of photosensitive drums, each developing cartridge accommodating section accommodating therein a developing cartridge having a casing, each developing cartridge accommodating section including a connecting frame extending in the first direction and connected to the pair of side frames. Each connecting frame supports the casing of the developing cartridge accommodated in the developing cartridge accommodating section at one side in the second direction when a rotational moment is exerted on the developing cartridge during development. The casing of the developing cartridge is seated on at least two abutment portions, the at least two abutment portions being positioned spaced away from each another in the first direction and deviated toward the one side on the each connecting frame in the second direction, wherein the plurality of connecting frames includes an endmost connecting frame in the second direction having specific abutment portions resiliently movable in a pressing direction of the developing cartridge against the specific abutment portions.

DETAILED DESCRIPTION

First, a general configuration of a color printer 1 that can accommodate therein a tandem drum unit 3 according to an embodiment of the present invention will be described with reference to FIG. 1.

In the following description, a left side of FIG. 1 will be referred to as a front side, while a right side of FIG. 1 will be referred to as a rear side. The terms "upward", "downward", "upper", "lower", "above", "below", "beneath", "right", "left", "front", "rear" and the like will be used assuming that the color printer 1 is viewed from its front side. Also, directions with respect to the drum unit 3 will be referenced based on an assumption that the drum unit 3 is accommodated within the color printer 1.

Figure 1:
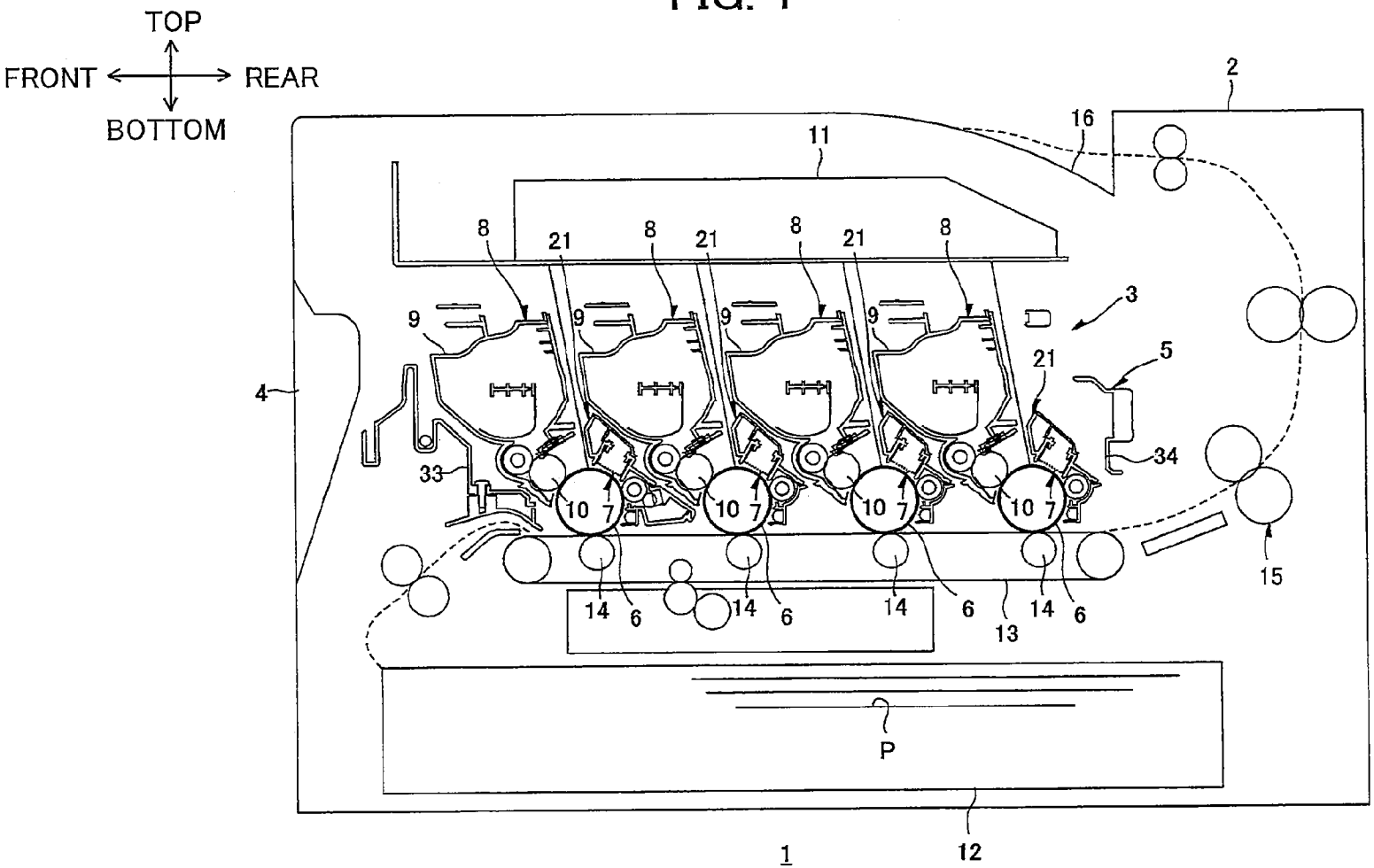
FIG. 1 is a cross-sectional view of a laser printer provided with a tandem drum unit according to an embodiment of the present invention, the drum unit including four developing cartridges.

As shown in FIG. 1, the color printer 1 includes a main casing 2 within which the drum unit 3 is accommodated. A front cover 4 is pivotably movably provided at a front side of the main casing 2. When the front cover 4 is opened, the drum unit 3 is movable relative to the main casing 2 with respect to a horizontal direction. More specifically, the drum unit 3 is movable between an accommodated position in which the drum unit 3 is accommodated within the main casing 2 (shown in FIG. 1), and a withdrawn position (not shown) in which the drum unit 3 is pulled out of the main casing 2.

The drum unit 3 includes a unit frame 5 to which four photosensitive drums 6 are rotatably supported. Each of the four photosensitive drums 6 is rotatable about its axis (not shown) extending in a left-to-right direction. The four photosensitive drums 6 are respectively provided for four colors: black, yellow, magenta and cyan, and are juxtaposed at equi-intervals in a front-to-rear direction according to the order of colors given above.

The unit frame 5 has a pair of side walls 31, 32 (see FIGS. 2 to 4) extending in the front-to-rear direction and facing each other in the left-to-right direction. Four chargers 7 are retained between the side walls 31, 32. The chargers 7 have a one-to-one correspondence to the four photosensitive drums 6 and disposed at positions diagonally rearward and upward of the corresponding photosensitive drums 6, as shown in FIG. 1. Each charger 7 is a Scorotron charger that includes a discharge wire and a grid, for example.

In the drum unit 3, four developing cartridges 8 are also retained. The four developing cartridges 8 are detachably mountable on the unit frame 5. The four developing cartridges 8 also have a one-to-one correspondence to the four photosensitive drums 6. When the drum unit 3 is pulled out of the main casing 2 to be in the withdrawn position, the developing cartridges 8 are mountable on the unit frame 5 from upward thereof, and, when mounted, disposed at positions diagonally frontward and upward of the corresponding photosensitive drums 6.

Each developing cartridge 8 has a developing cartridge casing 9 and a developing roller 10 rotatably supported to the developing cartridge casing 9. The developing roller 10 is rotatable about its axis extending in the left-to-right direction. The developing roller 10 has a circumferential surface a portion of which is exposed outside of the developing cartridge casing 9. When the developing cartridges 8 is mounted on the unit frame 5, the developing roller 10 is in contact with the corresponding photosensitive drum 6 at a position upward and frontward of the photosensitive drums 6.

Within the main casing 2, an exposure device 11, a sheet feed cassette 12 and a fixing unit 15 are also provided.

The exposure device 11 is disposed upward of the drum unit 3. The exposure device 11 is configured to irradiate four laser beams corresponding to the four colors used in the color printer 1. In stead of the exposure device 11, four LED arrays may be provided for the photosensitive drums 6.

As each photosensitive drum 6 rotates, the corresponding charger 7 applies a uniform charge to a surface of the photosensitive drum 6 through corona discharge. Subsequently, the exposure device 11 irradiates laser beams for selectively exposing the surfaces of the photosensitive drums 6 to selectively remove charges therefrom, thereby forming electrostatic latent images on the surfaces of the photosensitive drums 6. When each electrostatic latent image faces the corresponding developing roller 10 in accordance with rotation of the photosensitive drum 6, the developing roller 10 supplies toner to the electrostatic latent image to develop the image into a toner image.

The sheet feed cassette 12 is disposed at a lower portion of the main casing 2. The sheet feed cassette 12 accommodates therein sheets of paper P. The paper P accommodated in the sheet feed cassette 12 is conveyed onto a conveyor belt 13 by various rollers. The conveyor belt 13 is an endless belt, and has an upper portion that confronts each of the four photosensitive drums 6 from below thereof. Four transfer rollers 14 are disposed within a loop of the conveyor belt 13 such that each transfer rollers 14 opposes each photosensitive drum 6 via the upper portion of the conveyor belt 13. When the paper P is conveyed onto the conveyor belt 13, the conveyor belt 13 carries the paper P sequentially through positions between the conveyor belt 13 and each of the photosensitive drums 6. As the paper P passes beneath each photosensitive drum 6, the toner image carried on the surface of the photosensitive drum 6 is transferred onto the paper P.

The fixing unit 15 is disposed downstream of the conveyor belt 13 with respect to a direction in which the paper P is conveyed. The paper P on which the toner image has been transferred is then conveyed to the fixing unit 15 whereby the toner image is fixed to the paper P by heat and pressure. After the toner image has been fixed to the paper P in the fixing unit 15, various rollers discharge the paper P onto a discharge tray 16 formed on a top surface of the main casing 2.

Next, a detailed configuration of the drum unit 3 will be described with reference to FIGS. 2 through 7B.

Figure 2:
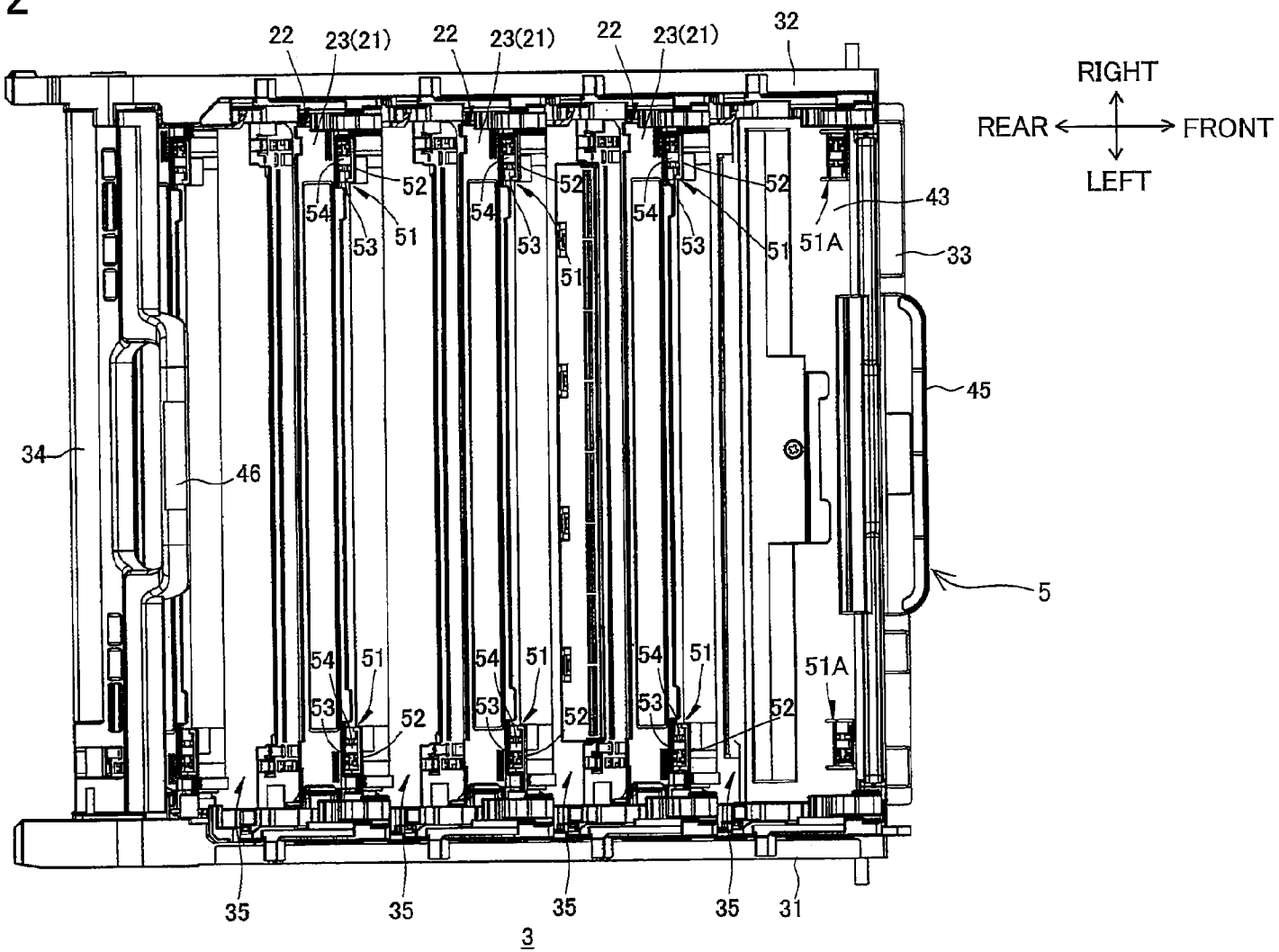
FIG. 2 is a plan view of the drum unit shown in FIG. 1, the drum unit including two front beam abutment portions.
Figure 3:
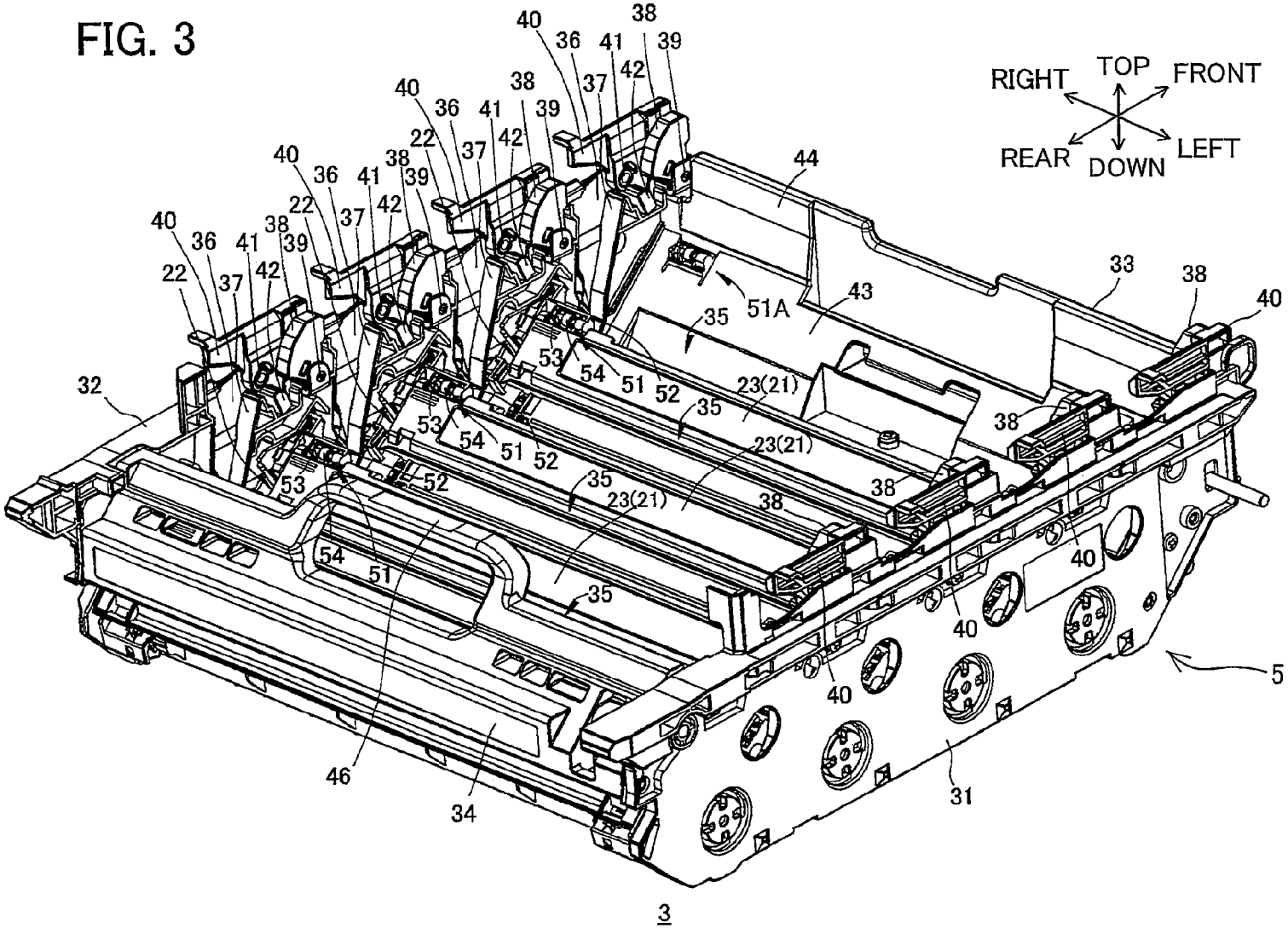
FIG. 3 is a perspective view of the drum unit of FIG. 2 when viewed from its upper rearward left side.
Figure 4:
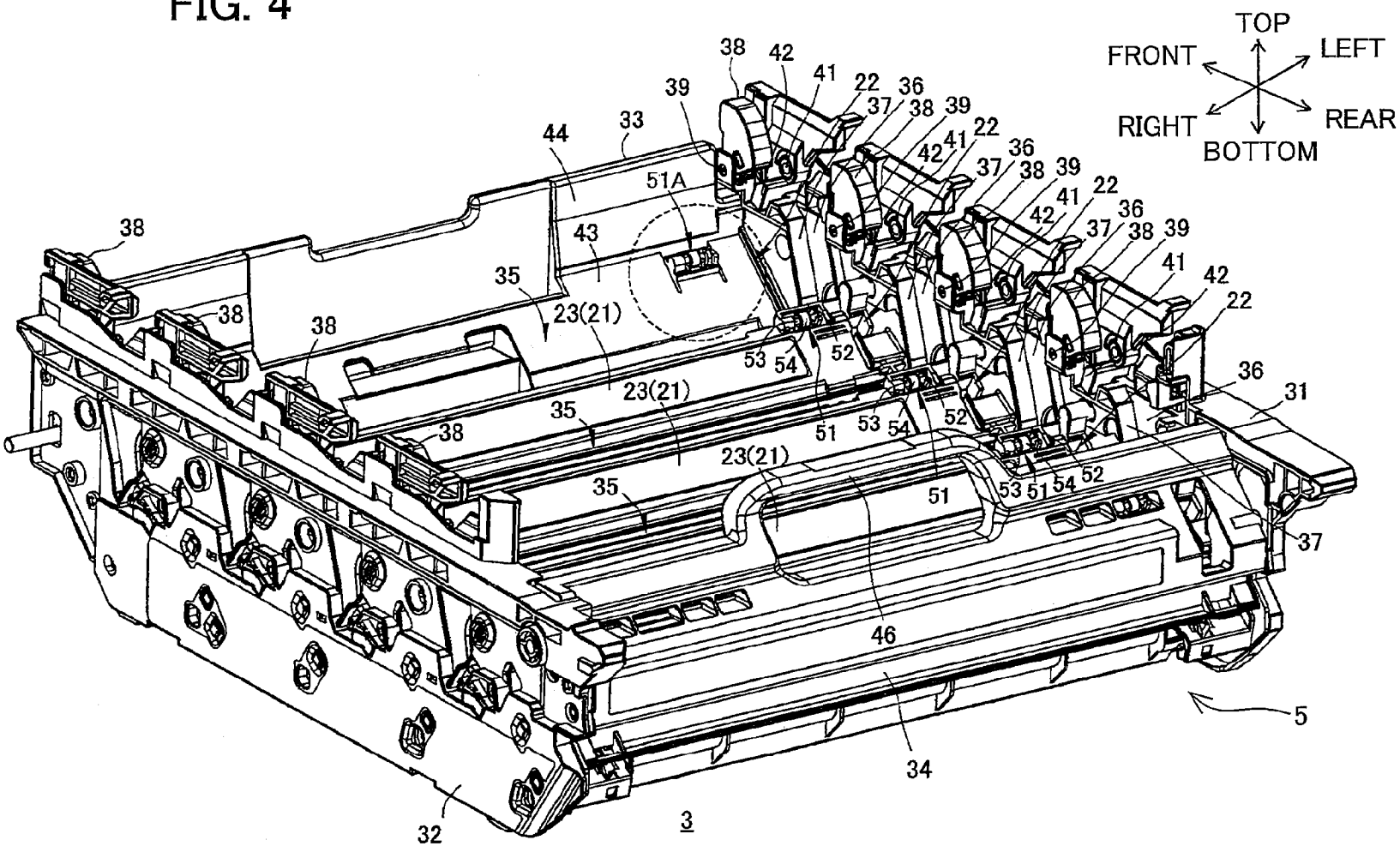
FIG. 4 is a perspective view of the drum unit of FIG. 2 when viewed from its upper rearward right side.

As shown in FIGS. 2 through 4, the drum unit 3 has the unit frame 5 that is square-shaped in a plan view. The unit frame 5 includes the pair of side walls 31, 32, a front beam 33 and a rear beam 34. The side walls 31, 32 are disposed in opposition to and in separation from each other in the left-to-right direction. The front beam 33 and the rear beam 34 respectively span across the side walls 31, 32 in the left-to-right direction. Specifically, the front beam 33 connects front end portions of the side walls 31, 32, while the rear beam 34 connects rear end portions of the side walls 31, 32.

Four drum sub units 22 are juxtaposed in the front-to-rear direction and are held between the side walls 31, 32 in the left-to-right direction. Each drum sub unit 22 includes a sub unit frame 21 to which the photosensitive drum 6 and its corresponding charger 7 are supported. In other words, the side walls 31, 32 of the unit frame 5 are connected via the four sub unit frames 21, the front beam 33 positioned frontward of the frontmost sub unit frame 21 and the rear beam 34 positioned rearward of the rearmost sub unit frame 21. That is, as shown in FIG. 2, the unit frame 5 has a ladder-like shape in which the four sub unit frames 21, the front beam 33, the rear beam 34 are all held between the pair of side walls 31, 32 on right and left sides thereof. An interval defined between the frontmost sub unit frame 21 and the front beam 33 is substantially identical to those defined between other neighboring sub unit frames 21.

The sub unit frame 21 is made of a resin. The sub unit frame 21 is resiliently deformable and has a rigidity smaller than that of the developing cartridge casing 9 of the developing cartridges 8. The sub unit frame 21 includes a center frame 23 as shown in FIGS. 2 through 4. The center frame 23 extends in the left-to-right direction and has a substantially rectangular plate shape in a plan view. As shown in FIGS. 3 and 4, the center frame 23 is arranged in such a state that the center frame 23 is inclined diagonally upward and frontward. The center frame 23 has a lower surface on which the charger 7 is retained.

A space is defined in each sub unit frame 21 at a position frontward thereof. This space serves as a developing cartridge accommodation section 35 for accommodating therein the developing cartridge 8 (see FIG. 1). That is, four developing cartridge accommodating sections 35 are defined by the four sub unit frames 21 and the front beam 33 between the pair of side walls 31, 32. As will be described later, the developing cartridge 8 is mounted in the developing cartridge accommodation section 35 from above.

As shown in FIGS. 3 and 4, each of side walls 31, 32 is formed with four developing cartridge guiding portions 36 for guiding mounting and dismounting of the developing cartridges 8 relative to the developing cartridge accommodation section 35. Specifically, four protrusions (rib-like walls) 37 are formed on each of the side walls 31, 32. Each protrusion 37 protrudes inward (toward the developing cartridge accommodation section 35) from an inner surface of each side wall 31, 32. The protrusion 37 has a substantially U-shape whose opening is facing upward. The protrusion 37 has a width in the front-to-rear direction that becomes wider toward the opening. An inner space of the protrusion 37 (a space bounded by the protrusion 37) serves as the developing cartridge guide portion 36.

Four pressing members 38 are also provided on each side wall 31, 32. Specifically; the pressing members 38 are disposed at positions in confrontation with the respective developing cartridge accommodation sections 35 in the left-to-right direction. The pressing member 38 has a substantially fan-like shape in a side view, as shown in FIGS. 3 and 4. More specifically, the pressing member 38 is formed in a fan-like plate shape whose central angle is about sixty degrees and whose circumferential surface is partially cut out therefrom. The pressing member 38 has a central portion through which a supporting shaft 39 rotatably penetrates. The supporting shaft 39 extends in left-to-right direction and is supported to one of the side walls 31, 32 so as not to rotate relative to the same. The pressing member 38 is therefore pivotally movable about the supporting shaft 39. The pressing member 38 is biased in a clockwise direction in a right side view (i.e., in a counterclockwise direction in FIG. 3) by a wire spring (not shown).

On each of the side walls 31, 32, four separating members 40 are further provided. The separating member 40 has a substantially right-angled triangular shape in a side view. The separating member 40 has a portion constituting a right angle that confronts the pressing member 38 from outward thereof in the left-to-right direction, and other portions constituting the remaining two angles that are positioned rearward of and downward of the pressing member 38 respectively. A supporting shaft 41 rotatably penetrates through the separating member 40 at a position rearward thereof. The supporting shaft 41 extends in the left-to-right direction and is supported to one of the side walls 31, 32 so as not to rotate relative to the same. The separating member 40 is thus pivotally movable about the supporting shaft 41. The separating member 40 is biased in a counterclockwise direction in a right side view (i.e., a clockwise direction in FIG. 3) by a wire spring (not shown).

The separating member 40 has a bottom end portion on which a pressing portion 42 is formed. The pressing portion 42 protrudes inward from an inner surface of the separating member 40. The pressing portion 42 has a protruding end that is in opposition to the pressing member 38 at a position downward and rearward of the same.

The front beam 33 is formed of a resin, and has a rigidity (strength) far higher than that of the developing cartridge casing 9 of the developing cartridge 8 so as not to undergo any deformation.

The front beam 33 has, as a rear surface, a sloped surface 43 and a vertical surface 44, as shown in FIGS. 3 and 4. The sloped surface 43 slopes diagonally upward and frontward and has an upper peripheral end portion from which the vertical surface 44 extends vertically upward. The front beam 33 has a front surface on which a front-side grip 45 is formed, as shown in FIG. 2. The front-side grip 45 projects slightly frontward from the front surface of the front beam 33 and has a substantially flat U-shape in a plan view.

The rear beam 34 is made of a resin. The rear beam 34 has a central portion at which a rear-side grip 46 is formed. The rear-side grip 46 projects and extends upward from an upper peripheral end portion of the rear beam 34, and has a substantially flat U-shape in a front view.

As shown in FIG. 2, two abutment portions 51 are provided at a front portion of each developing cartridge accommodation section 35. The two abutment portions 51 are spaced away from each other in the left-to-right direction.

More specifically, in the three developing cartridge accommodation sections 35 other than the frontmost developing cartridge accommodation section 35, the two abutment portions 51 are disposed on an upper peripheral end portion of the center frame 23 of each sub unit frame 21. Each abutment portion 51 includes an accommodation frame 52, a rotational shaft 53 and a roller 54. The accommodation frame 52 is integrally formed with the center frame 23 and projects frontward from the upper peripheral end portion of the center frame 23. The accommodation frame 52 has a substantially C-shape having two right-angles in a plan view, whose widthwise ends constituting an opening of the substantially C-shape are connected to the upper peripheral end portion of the center frame 23. The rotational shaft 53 extends in the left-to-right direction and rotatably supported within the accommodation frame 52. The roller 54 is held to the rotational shaft 53 so as not to rotate relative to the same.

With respect to the frontmost developing cartridge accommodation section 35, two abutment portions 51 are disposed on the upper peripheral end portion of the sloped surface 43 of the front beam 33. The abutment portions 51 are arranged to be spaced away from each other in the left-to-right direction. Hereinafter, the two abutment portions 51 that are provided on the sloped surface 43 of the front beam 33 will be referred to as front beam abutment portions 51A, whenever necessary, for differentiation from the other three pairs of abutment portions 51 provided on the sub unit frames 21.

Figure 5:
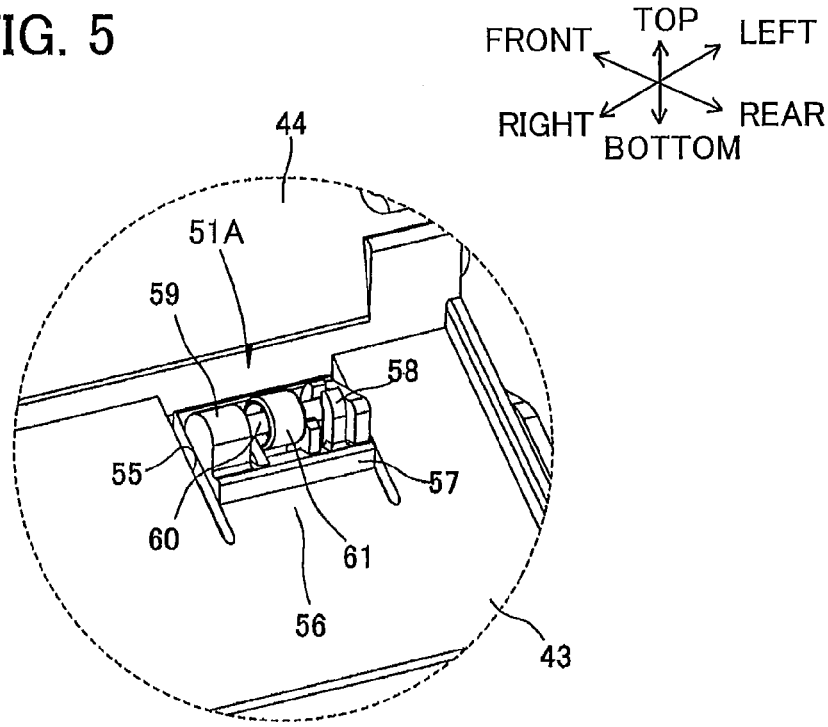
FIG. 5 is an enlarged perspective view of the front beam abutment portion enclosed by a broken line shown in FIG. 4.

As shown in FIG. 5, each front beam abutment portion 51A is disposed within a rectangular-shaped opening 55 formed on the sloped surface 43. The front beam abutment portion 51A includes a connecting portion 56, a roller retaining portion 57, a rotational shaft 60 and a roller 61.

The connecting portion 56 is connected to a lower peripheral end portion of the opening 55. The roller retaining portion 57 is formed to be continuous with the connecting portion 56. That is, the connecting portion 56 and the roller retaining portion 57 are integrally formed with the front beam 33. The connecting portion 56 has a rectangular plate shape elongated in the left-to-right direction, and has left and right end portions in separation from the opening 55. The roller retaining portion 57 is formed at an upper front end portion of the connecting portion 56. On the roller retaining portion 57, a left bearing 58 having a substantially U-shaped side view and a right bearing 59 having a semi-circular shaped side view are formed. The left bearing 58 and the right bearing 59 project diagonally upward and rearward from the roller retaining portion 57. The left bearing 58 and the right bearing 59 rotatably support the rotational shaft 60. The roller 61 is held to the rotational shaft 60 so as not to rotate relative to the same.

In this way, each front beam abutment portion 51A is connected to the front beam 33 via the connecting portion 56 such that the roller retaining portion 57 is completely separated from the front beam 33, and the left and right end portions of the connecting portion 56 are cut off (separated) from the front beam 33. In other words, each front beam abutment portion 51A is provided at the front beam 33 such that only one side of the front beam abutment portion 51A is supported to the front beam 33, that is, the front beam abutment portion 51A is supported to the front beam 33 in a cantilevered manner. As a result, the front beam abutment portion 51A is allowed to have a resiliency that enables the front beam abutment portion 51A to move in a direction perpendicular to a direction in which the sloped surface 43 extends. The front beam abutment portion 51A has a rigidity lower than that of the developing cartridge casing 9 of the developing cartridge 8.

Figure 6:
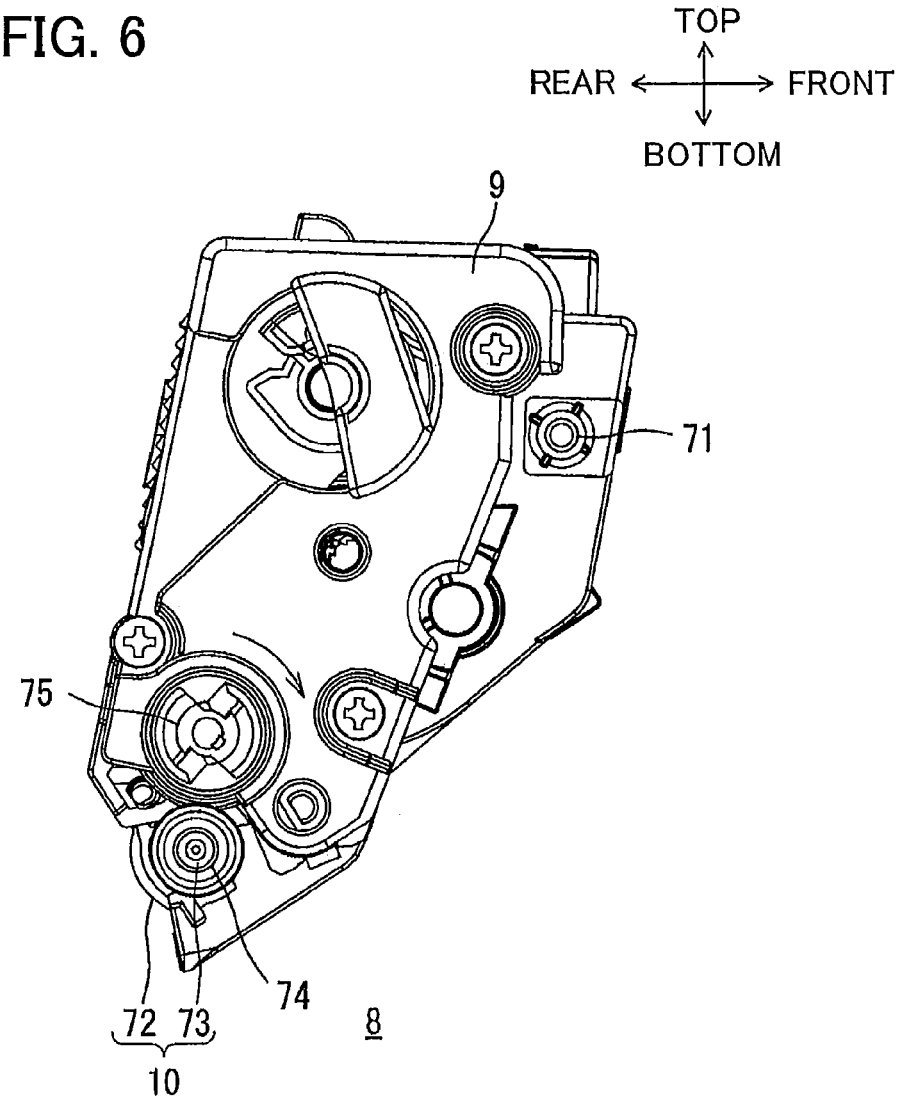
FIG. 6 is a left side view of the developing cartridge shown in FIG. 1, the developing roller including a developing roller.

As shown in FIG. 6, the developing cartridge casing 9 of the developing cartridge 8 has a substantially upside-down triangular shape in a side view. The developing cartridge casing 9 has a pair of left and right side walls (shown in FIG. 6 without reference numerals) each of whose upper front end portions is formed with a boss 71. Each boss 71 has a substantially cylindrical shape, protruding outward from an outer surface of each of the side walls in the left-to-right direction.

The developing roller 10 is supported to a lower end portion of the developing cartridge casing 9. More specifically, the developing roller 10 includes a cylindrical-shaped developing roller main body 72 and a developing roller shaft 73. The developing roller main body 72 has an axis extending in the left-to-right direction, and the developing roller shaft 73 penetrates through the developing roller main body 72 along the axis thereof. The developing roller shaft 73 has both widthwise ends projecting outward from left and right end surfaces of the developing roller main body 72. The widthwise ends of the developing roller shaft 73 penetrate through the left and right side walls of the developing cartridge casing 9 such that the developing roller shaft 73 is rotatably supported to the developing cartridge casing 9. Each widthwise end of the developing roller shaft 73 protruding from the developing cartridge casing 9 is fitted with a cylindrical-shaped shaft cover 74.

A developing coupling 75 is disposed on the outer surface of the left side wall of the developing cartridge casing 9 at a position upward of the developing roller shaft 73 (above the shaft cover 74). The developing coupling 15 is rotatable about its axis extending in the left-to-right direction. When the drum unit 3 on which the developing cartridge 8 has been mounted is loaded in the main casing 2 (see FIG. 1), a driving force is inputted to the developing coupling 75 from a motor (not shown) disposed within the main casing 2. Upon receipt of the driving force, the developing coupling 75 rotates in a clockwise direction as indicated by an arrow in FIG. 6. The rotation of the developing coupling 75 is transmitted to the developing roller 10 via the shaft cover 74, thereby rotating the developing roller 10 in a counterclockwise direction in FIG. 6.

In order for the developing cartridge 8 to be mounted on the drum unit 3 (in the developing cartridge accommodation section 35), the drum unit 3 is pulled out from the main casing 2 to be in the withdrawn position. The developing cartridge 8 is then placed upward of the developing cartridge accommodation section 35, and is moved toward the developing cartridge accommodation section 35 in a state where the developing roller 10 faces downward (in the state shown in FIG. 6). In the process of moving the developing cartridge 8 toward the developing cartridge accommodation section 35, each shaft cover 74 covering each widthwise end of the developing roller shaft 73 is inserted into the corresponding developing cartridge guide portion 36 from above. The shaft cover 74 is guided downward along the developing cartridge guide portion 36 in accordance with the movement of the developing cartridge 8, and the developing roller 10 approaches toward the corresponding photosensitive drum 6. When the developing roller 10 is brought into contact with the photosensitive drum 6, the developing cartridge 8 is prevented from moving further downward.

Subsequently, an upper end portion of the developing cartridge 8 is pressed forward. As a result, the developing cartridge 8 is tilted frontward about the shaft cover 74 (as a fulcrum). In the meantime, the boss 71 passes between the pressing member 38 and the pressing portion 42 of the separating member 40, and is slidingly moved downward to come beneath the pressing member 38 where the boss 71 pushes the pressing member 38 upward against a biasing force of the wire spring (not shown) of the pressing member 38. When the developing cartridge 8 leans on the sub unit frame 21 or the front beam 33 and the developing cartridge casing 9 is brought into contact with the corresponding two abutment portions 51, the developing cartridge 8 is prevented from being tilted further frontward. Installation of the developing cartridge 8 in the developing cartridge accommodation section 35 is thus completed. At this time, since the pressing member 38 presses the boss 71 from frontward and upward of the same, the developing roller 10 is brought into pressure-contact with the photosensitive drum 6.

Figure 7A:
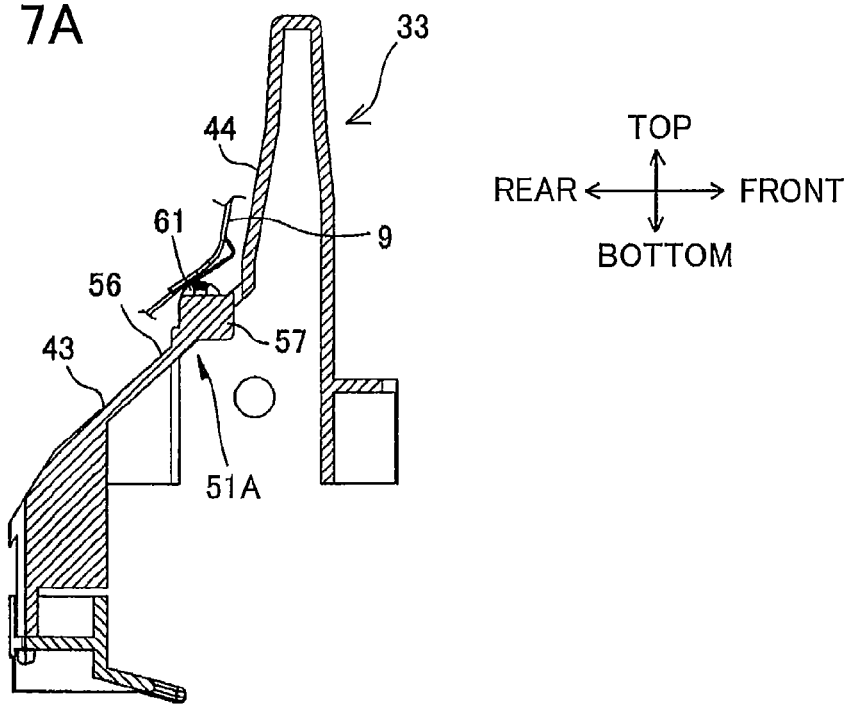
FIG. 7A is a vertical cross-sectional view of the front beam abutment portion of FIG. 2 and in the vicinity thereof, and illustrating a state in which a casing of the developing cartridge is in contact with the front beam abutment portion when the developing roller is not rotating.

When the developing roller 10 is not rotating, that is, when the driving force is not inputted to the developing coupling 75, the developing cartridge casing 9 is in contact with the rollers 54 of the abutment portions 51 or the or the rollers 61 of the front beam abutment portions 51A with a lesser force. At this time, even though the developing cartridge casing 9 abuts on the rollers 54, the sub unit frame 21 is neither resiliently deformed nor distorted. Likewise, since the developing cartridge casing 9 contacts the rollers 61 of the front beam abutment portions 51A with a lesser force, each front beam abutment portion 51A is not resiliently deformed, as shown in FIG. 7A.

On the other hand, when the driving force is inputted to the developing coupling 75 and the developing roller 10 is rotating, a rotational moment is generated on the developing cartridge 8 in a direction in which the developing coupling 75 rotates, i.e., in the clockwise direction in FIG. 6. Due to this rotational moment, the force with which the developing cartridge casing 9 abuts on the rollers 54 (rollers 61) increases.

The sub unit frame 21 is resiliently deformable. Therefore, when the abutment force of the developing cartridge casing 9 against the rollers 54 increases, the sub unit frame 21 is caused to resiliently deform or to be distorted so that the developing cartridge 8 can be reliably supported at four contact points: at two contact points where the shaft covers 74 and the side walls 31, 32 are in contact with each other; and at two contact points where the developing cartridge casing 9 and the two rollers 54 are in contact with each other.

Figure 7B:
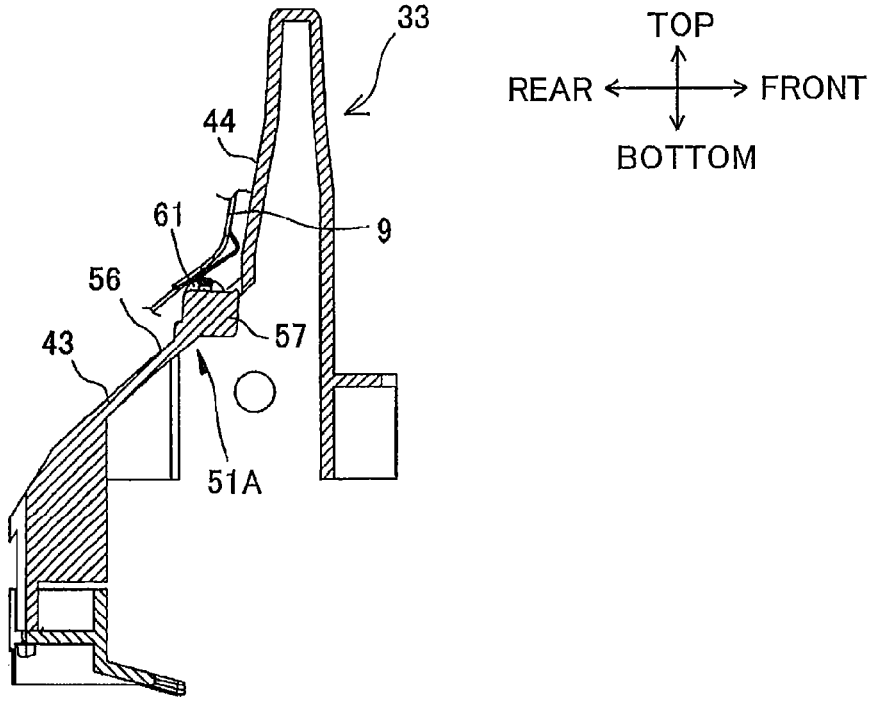
FIG. 7B is a vertical cross-sectional view of the front beam abutment portion of FIG. 2 and in the vicinity thereof, and illustrating a state in which the casing of the developing cartridge is in contact with the front beam abutment portion during rotation of the developing roller.

The front beam 33 is formed to have such a rigidity that the front beam 33 is not allowed to resiliently deform in consideration of enhancement of transportability of the drum unit 3 at the time of shipment. Therefore, even though the abutment force of the developing cartridge casing 9 against the rollers 54 increases, the front beam 33 is subjected to less distortion or deformation. Instead, as shown in FIG. 7B, when the abutment force of the developing cartridge casing 9 increases, the front beam abutment portions 51A are moved downward due to its resilient deformation such that the developing cartridge 8 is reliably supported at four contact points: at two contact points where the shaft covers 74 and the side walls 31, 32 are in contact with each other; and at two contact points where the developing cartridge casing 9 and the two rollers 61 are in contact with each other.

Incidentally, the color printer 1 has two operation modes: a color mode in which the color printer 1 forms a colored image on the paper P, and a monochrome mode in which the color printer 1 forms a monochrome (black and white) image on the paper P. In the color mode, all the developing rollers 10 are pressed against all the four photosensitive drums 6 respectively. In the monochrome mode, only one of the developing rollers 10 is pressed against the photosensitive drum 6 for the color of black, while remaining three photosensitive drums 6 for yellow, magenta and cyan are separated from their corresponding developing rollers 10.

In order for the developing rollers 10 to be separated from the photosensitive drums 6, the pressing portion 42 of the separating member 40 pushes the corresponding boss 71 of the developing cartridge 8 upward. That is, due to a cam mechanism (a translation cam, for example), the separating member 40 is pivotally moved in a clockwise direction in a right side view against a biasing force of the wire spring (not shown) biasing the separating member 40. In accordance with the pivotal movement of the separating member 40, the pressing portion 42 contacts the boss 71 from below and pushes the same upward. As a consequence, the boss 71 pushes the pressing member 38 upward against the biasing force of the wire spring (not shown) of the pressing member 38. Thereby, the developing cartridge 8 is brought upward and the developing roller 10 is separated from the corresponding photosensitive drum 6.

When the boss 71 is released from being pushed upward by the pressing portion 42, the pressing member 38 pushes the boss 71 downward such that the developing roller 10 is again brought into pressure-contact with the photosensitive drum 6.

As described above, the developing cartridge casing 9 of the developing cartridge 8 is supported by the sub unit frame 21 or the front beam 33 positioned adjacent to and frontward of the developing cartridge 8 in the front-to-rear direction. The sub unit frame 21 and the front beam 33 are respectively provided with a pair of abutment portions 51 and a pair of front beam abutment portions 51A. The pair of abutment portions 51 is aligned in the left-to-right direction and the pair of front beam abutment portions 51A is also aligned in the left-to-right direction. When the developing cartridge casing 9 of the developing cartridge 8 is supported by the sub unit frame 21, the abutment portions 51 are in abutment with the developing cartridge casing 9, while the front beam abutment portions 51A are in abutment with the developing cartridge casing 9 when the developing cartridge frame 9 of the developing cartridge 8 is supported by the front beam 33.

When the developing cartridge 8 is mounted in the developing cartridge accommodation section 35 and the developing roller 10 starts rotating for development, the rotational moment is generated on the developing cartridge 8. However, the front beam abutment portions 51A disposed on the front beam 33 are capable of resiliently deform such that each front beam abutment portion 51A is movable in a direction in which the developing cartridge 8 is being pressed against the front beam abutment portions 51A, i.e., in a direction perpendicular to a radial direction of the roller 61 including an abutment position where the roller 61 is in abutment with the developing cartridge frame 9 of the developing cartridge 8.

With this configuration, even when the developing cartridge casing 9 of the developing cartridge 8 is pressed hard against the front beam 33 due to the rotational moment generated on the developing cartridge 8, each front beam abutment portion 51A is allowed to resiliently move so that deformation of the developing cartridge casing 9 can be prevented. As a result, a contact pressure between the developing roller 10 and the photosensitive drum 6 can be made uniform with respect to an axial direction of the photosensitive drum 6, thereby preventing defects in image formation (such as defective printing) from occurring.

Further, the front beam abutment portion 51A has only one side at which the front beam abutment portion 51A is supported to the front beam 33. That is, the front beam abutment portion 51A has a cantilevered structure. Specifically, the front beam abutment portion 51A is separated from the front beam 33 in the left-to-right direction, but is connected to the front beam 33 via the connecting portion 56 extending in the left-to-right direction. In other words, the front beam abutment portion 51A is surrounded by a groove having a substantially C-shaped contour with two right angles: the groove has a first side extending the front-to-rear direction, a second side extending in the front-to-rear direction and in opposition to the first side, and a third side extending in the left-to-right direction and connecting front ends of the first and second sides. A portion of the front beam abutment portion 51A that is not surrounded formed by the groove (between rear ends of the first and second sides of the groove) serves as the connecting portion 56 that connects the front beam abutment portion 51A and the front beam 33.

With this configuration, even when the developing cartridge casing 9 of the developing cartridge 8 is tightly pressed against the front beam abutment portion 51A, the front beam abutment portion 51A can reliably resiliently move in the direction in which the developing cartridge frame 9 is pressed against the front beam abutment portion 51A. As a result, deformation or distortion of the developing cartridge casing 9 of the developing cartridge 8 can be further prevented.

Further, each abutment portion 51 is provided with the roller 54 rotatable with the rotational shaft 53, while each front beam abutment portion 51A is provided with the roller 61 rotatable with the rotational shaft 60. With this configuration, when the developing cartridge 8 is moved relative to the corresponding photosensitive drum 6 so as to be in pressure-contact with or in separation from the photosensitive drum 6, the rollers 54, 61 can rotate in accordance with the movement of the developing cartridge 8 while the developing cartridge casing 9 and the roller 54 or the roller 61 are in abutment with each other. Therefore, abrasion between the developing cartridge casing 9 and the rollers 54, 61 attributed to sliding contact therebetween can be prevented.

Further, the front-side grip 45 is formed on the front beam 33. Therefore, a user can grip the front-side grip 45 for moving the drum unit 3. Operability of the drum unit 3 can be therefore improved.

To this effect, the front beam 33 is required to have a sufficient strength (rigidity) so as not to be resiliently deformed by a force exerted by the user's gripping the front-side grip 45 for moving the drum unit 3. Even though the front beam 33 has such strength, the front beam abutment portions 51A provided on the front beam 33 are resiliently deformable and movable. Because of the provision of such resiliently movable front beam abutment portions 51A, the developing cartridge casing 9 of the developing cartridge 8 can be prevented from being deformed or distorted even if the developing cartridge casing 9 is tightly pressed against the front beam 33.

Further, the front beam abutment portion 51A has a rigidity lower than that of the developing cartridge casing 9 of the developing cartridge 8. Therefore, the front beam abutment portion 51A can reliably resiliently move in response to the pressure-contact of the developing cartridge casing 9 against the front beam 33. Deformation of the developing cartridge casing 9 can be thus prevented reliably.

While the present invention has been described with respect to specific embodiments, it will be appreciated by one skilled in the art that a variety of changes may be made without departing from the scope of the invention.

What is claimed is:

1. A tandem drum unit comprising:

a pair of side plates disposed in opposition to each other in a first direction, each side plate extending in a second direction perpendicular to the first direction;

a plurality of photosensitive drums juxtaposed in the second direction and interposed between the pair of side plates in the first direction, each photosensitive drum having an axis extending in the first direction and supported rotatably about the axis by the pair of side plates;

a plurality of developing cartridge accommodating sections arrayed in the second direction in correspondence with the plurality of photosensitive drums, each developing cartridge accommodating section accommodating therein a developing cartridge having a casing, each developing cartridge accommodating section comprising a connecting frame extending in the first direction and connected to the pair of side frames, each connecting frame supporting the casing of the developing cartridge accommodated in the developing cartridge accommodating section at one side in the second direction when a rotational moment is exerted on the developing cartridge during development; and at least two abutment portions on which the casing of the developing cartridge is seated, the at least two abutment portions being provided on each connecting frame and positioned spaced away from each another in the first direction and deviated toward the one side on the each connecting frame in the second direction, wherein the plurality of connecting frames includes an endmost connecting frame in the second direction having specific abutment portions resiliently movable in a pressing direction of the developing cartridge against the specific abutment portions, wherein the endmost connecting frame has a connecting portion for a connection to each of the specific abutment portions, each of the connecting portions extending in the first direction and having lateral edges separated from the endmost connecting frame in the first direction, each of the connecting portions having one end connected to the endmost connecting frame and another end connected to each of the specific abutment portions in the second direction, and wherein each of the specific abutment portions is connected to the endmost connecting frame only via the one end of the connecting portion such that each of the specific abutment portions is supported at the endmost connecting frame in a cantilevered manner.

2. The tandem drum unit according to claim 1, wherein each specific abutment portion has a rigidity lower than that of the casing of the developing cartridge to cause resilient movement of the specific abutment portion against pressure from the casing.

3. The tandem drum unit according to claim 2, wherein the endmost connecting frame has a rigidity higher than that of the casing of the developing cartridge.

4. The tandem drum unit according to claim 1, wherein each abutment portion includes a roller rotatable about an axis extending in the first direction, the casing of the developing cartridge being in abutment with the roller at an abutment position.

5. The tandem drum unit according to claim 4, wherein the roller of the specific abutment portion is mounted on the base section and is movable in a locus extending in a radial direction of the roller and passing through the abutment position.

6. The tandem drum unit according to claim 1, wherein the endmost connecting frame has a hand grip.

* * * * *